US009664014B2

(12) United States Patent
Pei et al.

(10) Patent No.: US 9,664,014 B2
(45) Date of Patent: May 30, 2017

(54) METHOD AND SYSTEM FOR SEGMENTAL FLOW CONTROL IN OIL-GAS WELL

(75) Inventors: Bailin Pei, Beijing (CN); Yong Xue, Beijing (CN); Songmei Zhang, Beijing (CN)

(73) Assignee: Anton Bailin Oilfield Technologies (Beijing) Co., Ltd. (CN)

( * ) Notice: Subject to any disclaimer, the term of this patent is extended or adjusted under 35 U.S.C. 154(b) by 890 days.

(21) Appl. No.: 13/514,743

(22) PCT Filed: Dec. 8, 2010

(86) PCT No.: PCT/CN2010/079550

§ 371 (c)(1),
(2), (4) Date: Jun. 8, 2012

(87) PCT Pub. No.: WO2011/069447

PCT Pub. Date: Jun. 16, 2011

(65) Prior Publication Data

US 2012/0241168 A1 Sep. 27, 2012

(30) Foreign Application Priority Data

Dec. 11, 2009 (CN) ..... 2009 1 0250793

(51) Int. Cl.
*E21B 43/12* (2006.01)
*E21B 43/14* (2006.01)

(52) U.S. Cl.
CPC ..... *E21B 43/12* (2013.01); *E21B 43/14* (2013.01)

(58) Field of Classification Search
CPC ..... E21B 43/02; E21B 43/04; E21B 43/14; E21B 33/13
See application file for complete search history.

(56) References Cited

U.S. PATENT DOCUMENTS 7,413,022 B2 8/2008 Broome et al.
2002/0020524 A1 2/2002 Gano
(Continued)

FOREIGN PATENT DOCUMENTS

CN 1918361 A 2/2007
CN 101238271 A 8/2008
(Continued)

OTHER PUBLICATIONS

For the American Heritage Dictionary definition: control. (n.d.) American Heritage® Dictionary of the English Language, Fifth Edition. (2011). Retrieved Feb. 19, 2016 from http://www.thefreedictionary.com/control.*

*Primary Examiner* — Wei Wang
(74) *Attorney, Agent, or Firm* — Baker & Hostetler LLP

(57) ABSTRACT

A method and a system for segmental flow control in an oil-gas well are disclosed. The oil-gas well includes a first annular space (111) and a second annular space (103). The first annular space (111) is formed with the space between the borehole wall (101) of the oil-gas well and a perforated tube (102) which is in the oil-gas well and extends along an axial direction of the oil-gas well; The second annular space (103) which is formed with the space between the perforated tube (102) and a flow-control filter string (105) which is in the perforated tube (102) and extends along the axial direction of the oil-gas well. The method includes filling anti-channeling isolating particles (109) in the first annular space (111) and the second annular space (103) to enable fluid to flow in the first annular space (111) and the second annular space (103) filled with the anti-channeling isolating particles (109) in the manner of seepage.

14 Claims, 2 Drawing Sheets

(56) References Cited

U.S. PATENT DOCUMENTS

| | | | | |
|---|---|---|---|---|
| 2003/0075315 | A1* | 4/2003 | Nguyen et al. | 166/51 |
| 2008/0230223 | A1* | 9/2008 | McCrary et al. | 166/272.2 |
| 2009/0000787 | A1 | 1/2009 | Hill et al. | |

FOREIGN PATENT DOCUMENTS

| | | | |
|---|---|---|---|
| CN | 101463719 | A | 6/2009 |
| CN | 201254976 | Y | 6/2009 |
| CN | 101476455 | A | 7/2009 |
| CN | 101705808 | A | 5/2010 |
| CN | 101705809 | A | 5/2010 |
| CN | 101705810 | A | 5/2010 |
| CN | 101748999 | B | 9/2012 |
| WO | WO 2005/078235 | A1 | 8/2005 |
| WO | WO 2011/069447 | A1 | 6/2011 |

* cited by examiner

METHOD AND SYSTEM FOR SEGMENTAL FLOW CONTROL IN OIL-GAS WELL

CROSS-REFERENCE TO RELATED APPLICATIONS

This application is the National Stage of International Application No. PCT/CN2010/079550, filed Dec. 8, 2010, which claims the benefit of Chinese Application No. 200910250793.1, filed Dec. 11, 2009, the disclosures of which are incorporated herein by reference in their entireties.

FIELD OF THE INVENTION

The present application relates to a flow control method in an oil-gas well exploitation field, and in particular to a sectional flow control method using a flow control filter string in an oil-gas well having a perforated pipe.

BACKGROUND OF THE INVENTION

An oil-gas well generally refers to a production well in the oil-gas field development in a broad sense, including an oil well, a gas well, an injection well and so on. In the production process of the oil-gas well, due to the heterogeneous characteristic of the oil reservoir, the oil-gas well, regardless of a vertical well or a horizontal well, has to be sealed off and separated into multiple independent zones for production. The oil-gas well production mentioned herein includes the production and injection of the fluid in the oil-gas well production process, for example, injecting water and vapor into the formation in the petroleum exploitation or production process, and injecting chemical agents for improving the oil field recovery ratio, and also includes the injection of acid liquor into the formation in some operation processes, etc.

During the process of sealing off and separating the oil-gas well into multiple independent zones for production, a device for controlling flow rate in sections (for example, a flow control filter string), and a device for separating the production section of the oil-gas well into several flow units along the axial direction of the oil-gas well (for example, a packer) are generally used to realize the seal and separation of the zones, so as to realize relatively independent production.

FIG. 1 is a schematic view illustrating the flow control by using a flow control filter string and a packer in an open hole. In FIG. 1, reference numeral 1 indicates a borehole wall of the oil-gas well, reference numeral 2 indicates a flow control filter string, reference numeral 3 indicates an annular space between the flow control filter string and the borehole wall, reference numeral 4 indicates a packer hung with the flow control filter string, and reference numeral 5 indicates a flow control packer.

The process of sectional flow control is briefly described hereinafter with reference to FIG. 1. FIG. 1 shows a non-oil-bearing formation, an oil-bearing formation and bottom water under the oil-bearing formation. Various formations are schematically indicated by horizontal lines in FIG. 1, though the person skilled in the art may understand that these formations may not be horizontal, which depends on the geologic structure of the locality where the oil-gas well is located. The oil-gas well as shown in the figure includes a vertical section and a horizontal section. The horizontal section substantially extends along the oil-bearing formation so as to increase the contact area between the borehole wall and the oil-bearing formation. FIG. 1 illustratively shows two zones having different permeability, i.e. a high permeability zone and a low permeability zone. Under the situation without flow control in the oil-gas well (i.e. no packer 5 is provided in FIG. 1), since the permeability of the two zones is different, a flow rate of the fluid in the high permeability zone is larger than a flow rate of the fluid in the low permeability zone. In this case, due to the difference between the pressure of the bottom water and the pressure inside the oil-gas well, the bottom water under the oil-bearing formation may firstly pass through the high permeability zone and enter into the oil-gas well, which may cause the decrease of oil and gas and the increase of water in the production of the oil-gas well. This should be avoided in the production.

Currently, as shown in FIG. 1, the sectional flow-rate control production in many oil-gas wells is realized as follows. A flow control filter string 2 is lowered into the production section inside the oil-gas well, and the flow control filter string 2 and the packer 5 are used to effectively seal off and partition an annular space between the flow control filter string 2 and the production section inside the oil-gas well, i.e. axial channeling passage of fluid outside the flow control filter string is blocked, thereby realizing a better sectional flow-rate control production. Generally, the packer is provided between two zones having different permeability. Since the flow control filter can play a role of flow-rate control, the packer is used to pack off the zones having different permeability so as to perform independent control or sectional control of various zones having different permeability. Therefore, it is possible for the oil-gas well to achieve a good production, and to effectively control the quantity of the bottom water entering into the oil-gas well.

However, the current well completion of the oil-gas well is achieved by running a perforated pipe into an open hole, and an annular space between the perforated pipe and the open hole wall is not sealed by filling cement or other materials between the perforated pipe and the borehole wall. The well completion method has an advantage of the low cost, and a disadvantage that the annular space becomes a passage for fluid channeling, so that it is difficult to realize the sectional flow control in the later production. Each meter of the perforated pipe is provided with several to dozens of holes with a diameter about 10 mm. The perforated pipe is mainly used in the oil-gas well to support the borehole wall and prevent lumps in the well from entering into the perforated pipe so as to ensure that the whole flow passage of the oil-gas well is not blocked by lumps.

As shown in FIG. 2, if the flow control technology using the packer in the open hole as shown in FIG. 1 is directly applied in the existing oil-gas well having the perforated pipe, the annular space between the perforated pipe and the borehole wall cannot be packed off. Thus, the bottom water entering into the oil-gas well may flow axially in the annular space between the perforated pipe and the borehole wall. Thus, the annular space between the perforated pipe and the borehole wall forms an axial channeling passage, which destroys the pack-off effect between the flow control filter string in the perforated pipe and the perforated pipe, and cannot control the amount of water satisfactorily. In FIG. 2, reference numeral 11 indicates a borehole wall of the oil-gas well, reference numeral 12 indicates a perforated pipe, reference numeral 13 indicates an annular space between the perforated pipe and the borehole wall, reference numeral 14 indicates a packer hung with the perforated pipe, reference numeral 15 indicates a flow control filter string, reference numeral 16 indicates a flow control filter on the flow control filter string, reference numeral 17 indicates a packer provided in the annular space between the flow control filter string and the perforated pipe, and reference numeral 18 indicates a packer hung with the flow control filter string. A direction of arrows in the figure indicates the fluid channeling direction. As shown in FIG. 2, the fluid in the formation passes through the borehole wall and enters into the annular space between the borehole wall and the perforated pipe, so that the axial channeling is formed in the annular space between the borehole wall and the perforated pipe, and then passes through the flow control filter and enters into the flow control filter string. This axial channeling destroys the pack-off effect of the packer provided between the flow control filter string and the perforated pipe, thus a good water control effect can not be realized.

SUMMARY OF THE INVENTION

A technical problem to be solved by the present application is to provide a sectional flow control method using a flow control filter string in an oil-gas well having a perforated pipe, in which the annular space between the flow control filter string and the perforated pipe and the annular space between the perforated pipe and the borehole wall are filled with anti-channeling pack-off particles, so as to realize a good pack-off effect, thereby realizing a good sectional flow control production.

For solving the above problem, one embodiment of the present application provides a sectional flow control method in an oil-gas well, wherein the oil-gas well includes a first annular space formed between a borehole wall of the oil-gas well and a perforated pipe, and a second annular space formed between the perforated pipe and a flow control filter string. The perforated pipe is located inside the oil-gas well and extends along an axial direction of the oil-gas well. The flow control filter string is located inside the perforated pipe and extends along the axial direction of the oil-gas well. The method includes the step of: filling anti-channeling pack-off particles into the first annular space and the second annular space such that fluid can flow in a penetration manner in the first annular space and the second annular space filled with the anti-channeling pack-off particles.

Preferably, filling the anti-channeling pack-off particles into the first annular space and the second annular space is performed by injecting particle-carrying fluid with the anti-channeling pack-off particles into the first annular space and the second annular space.

Preferably, the particle-carrying fluid has a density substantially equal to a density of the anti-channeling pack-off particles.

Preferably, the particle-carrying fluid is water or aqueous solution.

Preferably, the anti-channeling pack-off particles are high molecular polymer particles with an average particle size ranging from 0.05 mm to 1.0 mm and a density ranging from 0.8 g/cm$^3$ to 1.4 g/cm$^3$.

Preferably, the anti-channeling pack-off particles are high molecular polymer particles with an average particle size ranging from 0.1 mm to 0.5 mm and a density ranging from 0.94 g/cm$^3$ to 1.06 g/cm$^3$.

Preferably, the anti-channeling pack-off particles are high-density polyethylene particles with an average particle size ranging from 0.1 mm to 0.05 mm and a density ranging from 0.90 g/cm$^3$ to 0.98 g/cm$^3$.

Preferably, the anti-channeling pack-off particles are styrene and divinylbenzene crosslinking copolymer particles with an average particle size ranging from 0.05 mm to 1.0 mm and a density ranging from 0.96 g/cm$^3$ to 1.06 g/cm$^3$.

Preferably, the anti-channeling pack-off particles are polypropylene and polyvinyl chloride high molecular polymer particles with an average particle size ranging from 0.05 mm to 1.0 mm and a density ranging from 0.8 g/cm$^3$ to 1.2 g/cm$^3$.

Preferably, the anti-channeling pack-off particles are filled into the first annular space and the second annular space until the first annular space and the second annular space are substantially full of the anti-channeling pack-off particles, and the first annular space and the second annular space are closed. Preferably, the oil-gas well is a horizontal well or an inclined well.

Preferably, a difference between a density of the particle-carrying fluid and a density of the anti-channeling pack-off particles is within a range of ±0.4 g/cm$^3$ or a range of ±0.2 g/cm$^3$.

According to another embodiment of the present application, a sectional flow control system for an oil-gas well is provided, including: a first annular space formed between a borehole wall of the oil-gas well and a perforated pipe; a second annular space formed between the perforated pipe and a flow control filter string; and anti-channeling pack-off particles. The perforated pipe is located inside the oil-gas well and extends along an axial direction of the oil-gas well. The flow control filter string is located inside the perforated pipe and extends along the axial direction of the oil-gas well. The anti-channeling pack-off particles are filled in the first annular space and the second annular space such that fluid can flow in a penetration manner in the first annular space and the second annular space filled with the anti-channeling pack-off particles.

Preferably, the first annular space and the second annular space are filled by injecting particle-carrying fluid with the anti-channeling pack-off particles into the first annular space and the second annular space.

Preferably, the particle-carrying fluid has a density substantially equal to a density of the anti-channeling pack-off particles.

Preferably, the particle-carrying fluid is water or aqueous solution.

Preferably, the anti-channeling pack-off particles are high molecular polymer particles with an average particle size ranging from 0.05 mm to 1.0 mm and a density ranging from 0.8 g/cm$^3$ to 1.4 g/cm$^3$.

Preferably, the anti-channeling pack-off particles are high molecular polymer particles with an average particle size ranging from 0.1 mm to 0.5 mm and a density ranging from 0.94 g/cm$^3$ to 1.06 g/cm$^3$.

Preferably, the anti-channeling pack-off particles are high-density polyethylene particles with an average particle size ranging from 0.1 mm to 0.5 mm and a density ranging from 0.90 g/cm$^3$ to 0.98 g/cm$^3$.

Preferably, the anti-channeling pack-off particles are styrene and divinylbenzene crosslinking copolymer particles with an average particle size ranging from 0.05 mm to 1.0 mm and a density ranging from 0.96 g/cm$^3$ to 1.06 g/cm$^3$.

Preferably, the anti-channeling pack-off particles are polypropylene and polyvinyl chloride high molecular polymer particles with an average particle size ranging from 0.05 mm to 1.0 mm and a density ranging from 0.8 g/cm$^3$ to 1.2 g/cm$^3$.

Preferably, the first annular space and the second annular space are substantially full of the anti-channeling pack-off particles, and are closed.

Preferably, the oil-gas well is a horizontal well or an inclined well.

Preferably, a difference between the density of the particle-carrying fluid and the density of the anti-channeling pack-off particles is within a range of ±0.4 g/cm$^3$ or a range of ±0.2 g/cm$^3$.

According to another embodiment of the present application, a sectional flow control method using a flow control filter string in an oil-gas well having a perforated pipe is provided, wherein the oil-gas well having the perforated pipe includes a borehole wall of the oil-gas well and the perforated pipe running in the oil-gas well, one end of the perforated pipe adjacent to a wellhead is fixedly connected to the borehole wall, and an annular space is formed between the perforated pipe and the borehole wall.

The sectional flow control method using a flow control filter string includes the following steps:

1) running the flow control filter string into the perforated pipe via a running string, wherein the flow control filter string is provided with a flow control filter, one end of the flow control filter string adjacent to the wellhead is fixedly connected to the borehole wall, and an annular space is formed between the flow control filter string and the perforated pipe;

2) injecting particle-carrying fluid with the anti-channeling pack-off particles into the annular space between the flow control filter string and the perforated pipe, wherein the particle-carrying fluid carrying the anti-channeling pack-off particles passes through holes in the perforated pipe and into the annular space between the perforated pipe and the borehole wall, the anti-channeling pack-off particles are accumulated both in the annular space between the flow control filter string and the perforated pipe and in the annular space between the perforated pipe and the borehole wall, so that the annular space between the flow control filter string and the perforated pipe and the annular space between the perforated pipe and the borehole wall are filled with and full of the anti-channeling pack-off particles, a part of the particle-carrying fluid enters into the flow control filter and then flows back to the ground, and another part of the particle-carrying fluid passes through the borehole wall and penetrates into the formation;

3) closing the annular space full of the anti-channeling pack-off particles between the flow control filter string and the perforated pipe; and 4) disengaging the running string which is connected to the flow control filter string, and forming a well completion structure in which the annular space between the flow control filter string and the perforated pipe and the annular space between the perforated pipe and the borehole wall are filled with the anti-channeling pack-off particles.

The particle density mentioned in the present application is the true density of the individual particles, rather than the packing density of the particles.

The present application uses water or aqueous solution with a density about 1 g/cm$^3$ as the particle-carrying fluid to carry anti-channeling pack-off particles, and the present application uses anti-channeling pack-off particles having almost the same density as the particle-carrying fluid, thus the particle-carrying fluid may easily carry the anti-channeling pack-off particles to fill in the annular space between the flow control filter string and the perforated pipe and the annular space between the perforated pipe and the borehole wall. The anti-channeling pack-off particles are accumulated both in the annular space between the flow control filter string and the perforated pipe and in the annular space between the perforated pipe and the borehole wall, so that the annular space between the flow control filter string and the perforated pipe and the annular space between the perforated pipe and the borehole wall are filled with and full of the anti-channeling pack-off particles. A part of the particle-carrying fluid enters into the flow control filter and then flows back to the ground, and another part of the particle-carrying fluid passes through the borehole wall and penetrates into the formation. Finally, a well completion structure is formed, in which the annular space between the flow control filter string and the perforated pipe and the annular space between the perforated pipe and the borehole wall are filled with the anti-channeling pack-off particles. The anti-channeling pack-off particles are filled tightly and there is almost no channeling. The oil-gas well may effectively be sealed off and separated into multiple independent zones with combination of the flow control filter string, so as to perform oil-gas well production, realize the object of flow control, and facilitate the flow-rate sectional management, thereby bringing good effects of the oil-gas well production, for example, improving the production efficiency of the oil-gas well.

Furthermore, even there still has channeling after filling with the anti-channeling pack-off particles, in production axial channeling of small flow rate of fluid may bring the anti-channeling pack-off particles to move and to be accumulated towards the channeling direction and then to fully fill the channeling passage, thereby achieving a very good anti-channeling pack-off effect and realizing the object of sectional flow control using a flow control filter string in an oil-gas well with the combination of a flow control filter string.

The formation fluid flows in media formed by the accumulation of the anti-channeling pack-off particles in the penetration manner. According to the principle of the penetration fluid mechanics, the penetration resistance is proportional to the penetration distance, and is inversely proportional to the penetration area. The accumulation body of the anti-channeling pack-off particles has a thin thickness, a small section and a long axial length. Accordingly, a channeling resistance of the formation fluid flowing in the anti-channeling pack-off particles along the axial direction of the oil-gas well is very high. However, when the formation fluid flows along the radial direction of the oil-gas well, the penetration area is big and the penetration distance is short, thus the flow resistance is very small. The resistance flowing in the accumulation body for several meters or tens of meters along the axial direction of the oil-gas well is hundreds times even thousands times more than the resistance flowing in the accumulation body for several centimeters along the radial direction of the oil-gas well. Due to the great difference between the resistance flowing in the accumulation body along the axial direction of the oil-gas well and the resistance flowing in the accumulation body along the radial direction of the oil-gas well, the flow rate flowing in the accumulation body along the axial direction of the oil-gas well is far less than the flow rate flowing in the accumulation body along the radial direction of the oil-gas well under the same pressure difference. Thus, under the difference between the resistance flowing in the accumulation body of the anti-channeling pack-off particles along the axial direction of the well and the resistance flowing in the accumulation body along the radial direction of the well, the smooth flow of the formation fluid in the accumulation body along the radial direction of the oil-gas well may be ensured, and the flow of the formation fluid along the axial direction of the oil-gas well may be limited, thereby functioning as a packer.

The present application provides a convenient and useful sectional flow control method using a flow control filter string in an oil-gas well having a perforated pipe, which may pack off the annular space between the flow control filter string and the perforated pipe and the annular space between the perforated pipe and the borehole wall, thereby having a good pack-off effect, realizing the sectional flow control production well, and satisfying the actual production requirements of the oil field, for example, improving the oil recovery ratio.

DETAILED DESCRIPTION OF THE EMBODIMENTS

Figure 1:
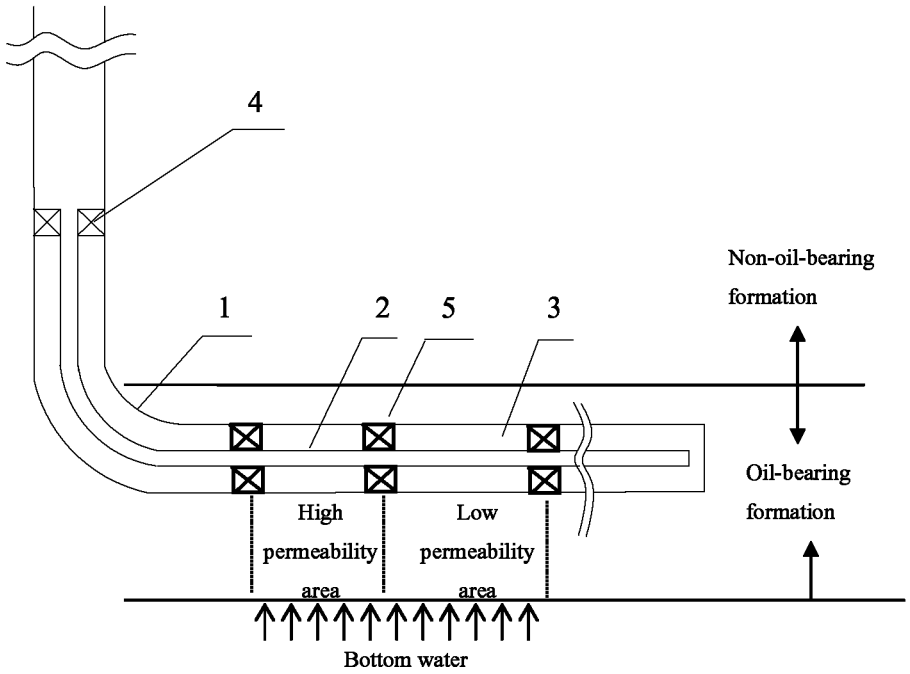
FIG. 1 is a schematic view illustrating the flow control by using a flow control filter string and a packer in an open hole in the prior art.
Figure 2:
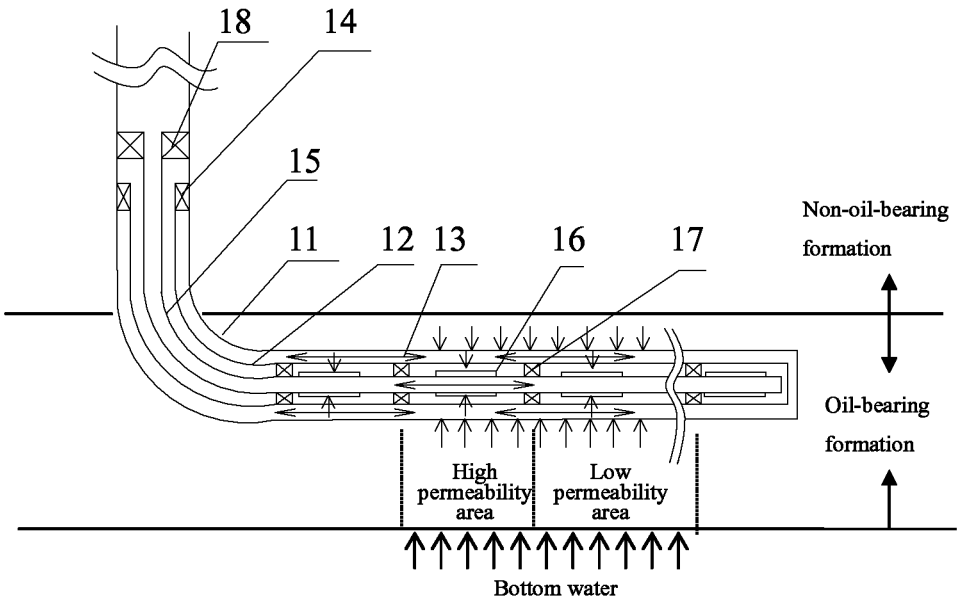
FIG. 2 is a schematic view of a hypothetical state where the flow control technology using the flow control filter string and the packer as shown in FIG. 1 is applied to an oil-gas well having a perforated pipe, the flow control filter string is lowered into the perforated pipe, an annular space between the flow control filter string and the perforated pipe is packed off, while an annular space between the perforated pipe and a borehole wall is not packed off.

Overall, the present application provides a sectional flow control method using a flow control filter string in an oil-gas well having a perforated pipe. The oil-gas well having the perforated pipe therein includes a borehole wall of the oil-gas well and the perforated pipe running into the oil-gas well. One end of the perforated pipe adjacent to a wellhead is fixedly connected to the borehole wall, and an annular space is formed between the perforated pipe and the borehole wall.

The sectional flow control method using the flow control filter string includes the following steps:

1) running the flow control filter string into the perforated pipe via a running string, wherein the flow control filter string is provided with a flow control filter, one end of the flow control filter string adjacent to a wellhead is fixedly connected to the borehole wall, and an annular space is formed between the flow control filter string and the perforated pipe;

2) injecting a particle-carrying fluid into the annular space between the flow control filter string and the perforated pipe; wherein the particle-carrying fluid carries the anti-channeling pack-off particles, the particle-carrying fluid carrying the anti-channeling pack-off particles passes through holes in the perforated pipe and enters into an annular space between the perforated pipe and the borehole wall, the anti-channeling pack-off particles are accumulated both in the annular space between the flow control filter string and the perforated pipe and the annular space between the perforated pipe and the borehole wall, so that the annular space between the flow control filter string and the perforated pipe as well as the annular space between the perforated pipe and the borehole wall is filled with and full of the anti-channeling pack-off particles, a part of the particle-carrying fluid enters into the flow control filter and then flows back to the ground, and another part of the particle-carrying fluid passes through the borehole wall and penetrates into the formation;

3) closing the annular space full of the anti-channeling pack-off particles between the flow control filter string and the perforated pipe; and 4) disengaging the running string which is connected to the flow control filter string, and forming a well completion structure in which the annular space between the flow control filter string and the perforated pipe and the annular space between the perforated pipe and the borehole wall are filled with the anti-channeling pack-off particles.

The particle-carrying fluid carrying the anti-channeling pack-off particles is water or aqueous solution.

The anti-channeling pack-off particles may be high molecular polymer particles with a particle size ranging from 0.05 mm to 0.7 mm and a density ranging from 0.8 $g/cm^3$ to 1.2 $g/cm^3$.

The anti-channeling pack-off particles may be high molecular polymer particles with an average particle size ranging from 0.05 mm to 1.0 mm and a density ranging from 0.8 $g/cm^3$ to 1.4 $g/cm^3$.

The anti-channeling pack-off particles may be high molecular polymer particles with an average particle size ranging from 0.1 mm to 0.5 mm and a density ranging from 0.94 $g/cm^3$ to 1.06 $g/cm^3$.

The anti-channeling pack-off particles may be high-density polyethylene particles with an average particle size ranging from 0.1 mm to 0.5 mm and a density ranging from 0.90 $g/cm^3$ to 0.98 $g/cm^3$.

The anti-channeling pack-off particles may be styrene and divinylbenzene crosslinking copolymer particles with an average particle size ranging from 0.05 mm to 1.0 mm and a density ranging from 0.96 $g/cm^3$ to 1.06 $g/cm^3$.

The anti-channeling pack-off particles may be polypropylene and polyvinyl chloride high molecular polymer particles with an average particle size ranging from 0.05 mm to 1.0 mm and a density ranging from 0.8 $g/cm^3$ to 1.2 $g/cm^3$.

The embodiments of the present application will be described in detail with reference to the drawings hereinafter.

First Embodiment

Figure 3:
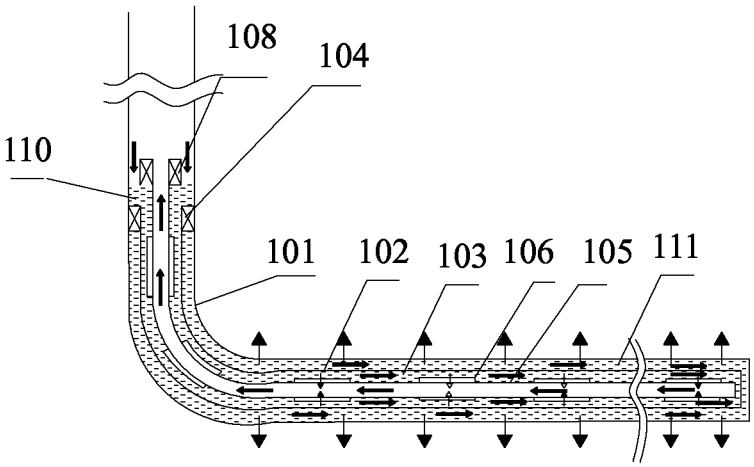
FIG. 3 is a schematic view of a sectional flow control method using a flow control filter string in an oil-gas well having a perforated pipe according to an embodiment of the present application.

The embodiment of the present application provides a sectional flow control method using a flow control filter string in an oil-gas well having a perforated pipe. As shown in FIG. 3, the oil-gas well structure having the perforated pipe includes a borehole wall 101 of the oil-gas well and a perforated pipe 102 running in the oil-gas well. Each meter of the perforated pipe 102 is provided with multiple small holes. For example, the number of the small holes is 30. The diameter of the small holes is configured to be able to prevent lumps from entering into the perforated pipe 102, for example 10 mm. A packer 104 hung with the perforated pipe 102 is provided between an upper portion of the perforated pipe 102 and the borehole wall 101. An annular space 103 is formed between the perforated pipe 102 and the borehole wall 101.

The water control pack-off method according to the embodiment of the present application is described in detail with reference to FIG. 3 hereinafter, which includes the following steps.

A flow control filter string 105 is run into the perforated pipe 102 via a running string (not shown). A flow control filter 106 is provided on the flow control filter string 105. A packer 108 hung with the flow control filter string 105 is provided between an upper portion of the flow control filter string 105 and the borehole wall 101. An annular space 103 is formed between the flow control filter string 105 and the perforated pipe 102.

A particle-carrying fluid 110 carrying the anti-channeling pack-off particles is injected into the annular space 103 between the flow control filter string 105 and the perforated pipe 102. The particle-carrying fluid 110 carrying the anti-channeling pack-off particles passes through small holes in the perforated pipe 102 and enters into the annular space 111 between the perforated pipe 102 and the borehole wall 101. The anti-channeling pack-off particles are accumulated both in the annular space 103 between the flow control filter string 105 and the perforated pipe 102 and in the annular space 111 between the perforated pipe 102 and the borehole wall 101, so that the annular space 103 between the flow control filter string 105 and the perforated pipe 102 and the annular space 111 between the perforated pipe 102 and the borehole wall 101 are filled with and full of the anti-channeling pack-off particles. A part of the particle-carrying fluid penetrates through the flow control filter 106 and enters into the flow control filter string 105 and then flows back to the ground, and another part of the particle-carrying fluid passes through the borehole wall 101 and penetrates into the formation. The direction of arrows in FIG. 3 is the flowing direction of the particle-carrying fluid. The anti-channeling pack-off particles are high-density polyethylene particles with an average particle size ranging from 0.1 mm to 0.5 mm and a density ranging from 0.90 g/cm$^3$ to 0.98 g/cm$^3$. The particle-carrying fluid is water.

The packer 108 hung with the flow control filter string 105 is set so as to close both the annular space 103 between the flow control filter string 105 and the perforated pipe 102 and the annular space 111 between the perforated pipe 102 and the borehole wall 101 which are filled with the anti-channeling pack-off particles.

Figure 4:
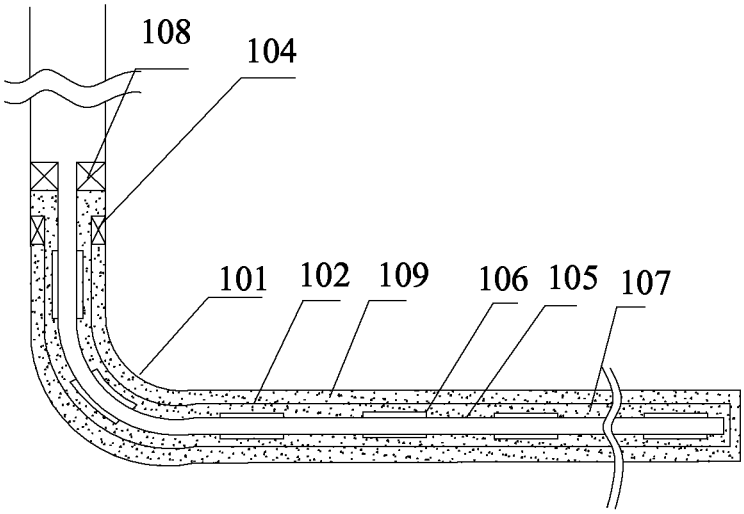
FIG. 4 is a schematic view of a well completion structure according to an embodiment of the present application, in which an annular space between the flow control filter string and the perforated pipe and an annular space between the perforated pipe and a borehole wall are both filled with anti-channeling pack-off particles.

The running string (not shown) connected to the flow control filter string 105 is disengaged and a well completion structure is formed. In the well completion structure, the annular space 103 between the flow control filter string 105 and the perforated pipe 102 and the annular space 111 between the perforated pipe 102 and the borehole wall 101 are filled with the anti-channeling pack-off particles, as shown in FIG. 4. In FIG. 4, reference numeral 101 indicates the borehole wall of the oil-gas well, reference numeral 102 indicates the perforated pipe, reference numeral 104 indicates the packer hung with the perforated pipe, reference numeral 105 indicates the flow control filter string, reference numeral 106 indicates the flow control filter on the flow control filter string, reference numeral 107 indicates the anti-channeling pack-off particles filled the annular space between the flow control filter string and the perforated pipe, reference numeral 108 indicates the packer hung with the flow control filter string, and reference numeral 109 indicates the anti-channeling pack-off particles filled the annular space between the perforated pipe and the borehole wall.

Second Embodiment

In the embodiment of the present application, the anti-channeling pack-off particles are polypropylene and polyvinyl chloride high molecular polymer particles with an average particle size ranging from 0.1 mm to 0.5 mm and a density being 0.97 g/cm$^3$.

The other steps of the method are the same as the first embodiment.

Third Embodiment

In the embodiment of the present application, the anti-channeling pack-off particles are styrene and divinylbenzene crosslinking copolymer particles with an average particle size ranging from 0.05 mm to 1.0 mm and a density ranging from 0.96 g/cm$^3$ to 1.06 g/cm$^3$.

The other steps of the method are the same as the first embodiment.

In the first, second and third embodiments of the present application, water is used to carry the anti-channeling pack-off particles. The density of water is 1 g/cm$^3$. The density of the anti-channeling pack-off particles selected in the present application is almost the same as the density of water. Therefore, the water may easily carry the anti-channeling pack-off particles to fill in the annular space 103 between the flow control filter string 105 and the perforated pipe 102 and the annular space 111 between the perforated pipe 102 and the borehole wall 101. The anti-channeling pack-off particles are accumulated both in the annular space 103 between the flow control filter string 105 and the perforated pipe 102 and in the annular space 111 between the perforated pipe 102 and the borehole wall 101, so that the annular space 103 between the flow control filter string 105 and the perforated pipe 102 and the annular space 111 between the perforated pipe 102 and the borehole wall 101 are filled with and full of the anti-channeling pack-off particles. A part of the water passes through the flow control filter 106 and enters into the flow control filter string 105 and then flows back to the ground, and another part of the water passes through the borehole wall 101 and penetrates into the formation. Finally, a well completion structure is formed, in which the annular space 103 between the flow control filter string 105 and the perforated pipe 102 and the annular space 111 between the perforated pipe 102 and the borehole wall 101 are filled with the anti-channeling pack-off particles.

The formation fluid flows in media formed by the accumulation of the anti-channeling pack-off particles in a penetration manner. According to the principle of the penetration fluid mechanics, the penetration resistance is proportional to the penetration distance, and is inversely proportional to the penetration area. The accumulation body of the anti-channeling pack-off particles is a medium having a thin thickness, a small section and a long axial length, thus the channeling resistance of the formation fluid flowing in the accumulation body of the anti-channeling pack-off particles along the axial direction of the oil-gas well is very high. However, when the formation fluid flows along the radial direction of the oil-gas well, the penetration area is big and the penetration distance is short, thus the flow resistance is very small. The resistance flowing in the accumulation body for several meters or tens of meters along the axial direction of the oil-gas well is hundreds times even thousands times more than the resistance flowing in the accumulation body for several centimeters along the radial direction of the oil-gas well. Due to the great difference between the resistance flowing in the accumulation body along the axial direction of the oil-gas well and the resistance flowing in the accumulation body along the radial direction of the oil-gas well, the flow rate flowing in the accumulation body along the axial direction of the oil-gas well is far less than the flow rate flowing in the accumulation body along the radial direction of the oil-gas well under the same pressure difference. Under the difference between the resistance flowing in the accumulation body of the anti-channeling pack-off particles along the axial direction of the well and the resistance flowing in the accumulation body along the radial direction of the well, the smooth flow of the formation fluid in the accumulation body along the radial direction of the oil-gas well may be ensured, and the flow of the formation fluid along the axial direction of the oil-gas well may be limited, thereby functioning as a packer.

The present application provides a convenient and useful sectional flow control method in an oil-gas well having a perforated pipe, which may pack off both the annular space between the flow control filter string and the perforated pipe and the annular space between the perforated pipe and the borehole wall. The sectional flow control production may be realized due to the good pack-off effect, so as to improve the oil recovery ratio and satisfy the actual production requirements of the oil field.

The production section referred in the present application is a generalized production section. There may be some non-flowing sections (for example, an interlayer, a sandwich layer and an imperforated interval after the casing cementing) along the length of the production section.

The flow control filter string in the present application includes filtering sections and blank sections which are arranged alternately. The blank section is a pipe without holes on its wall surface. The anti-channeling pack-off particle ring outside the blank sections plays a major role in preventing the axial channeling. The blank sections are provided in two ways. On the one hand, each filter itself includes a filtering section and blank sections provided at two ends of the filter and provided with screw threads, so that two filters may be connected via the screw threads on the blank sections of the two filters. When screwing and connecting the filters above the well, the blank section is a place for setting the pliers. On the other hand, an additional blank section may be connected between two filters. Under the situation that a relatively long flow control filter string is desired, the flow control filter string may be formed by connecting multiple flow control filters in series.

The anti-channeling pack-off particles in the present application is preferably circular.

In the embodiments of the present application, a sectional flow control method using a flow control filter string in an oil-gas well having a perforated pipe is provided, wherein the oil-gas well having the perforated pipe includes a borehole wall of the oil-gas well and the perforated pipe running into the oil-gas well, one end of the perforated pipe adjacent to a wellhead is fixedly connected to the borehole wall, and an annular space is formed between the perforated pipe and the borehole wall.

The sectional flow control method using a flow control filter string is characterized by including the following steps:

1) running the flow control filter string into the perforated pipe via a running string, the flow control filter string being provided with a flow control filter, the flow control filter string being fixed connected to the borehole wall, and an annular space being formed between the flow control filter string and the perforated pipe;

2) injecting particle-carrying fluid, which carries the anti-channeling pack-off particles, into the annular space between the flow control filter string and the perforated pipe; wherein the particle-carrying fluid carrying the anti-channeling pack-off particles passes through holes in the perforated pipe and enters into an annular space between the perforated pipe and the borehole wall, the anti-channeling pack-off particles are accumulated both in the annular space between the flow control filter string and the perforated pipe and in the annular space between the perforated pipe and the borehole wall, so that the annular space between the flow control filter string and the perforated pipe and the annular space between the perforated pipe and the borehole wall are filled with and full of the anti-channeling pack-off particles;

3) closing the annular space full of the anti-channeling pack-off particles between the flow control filter string and the perforated pipe, and closing the pack-off medium in the annular space between the perforated pipe and the borehole wall;

4) disengaging the running string which is connected to the flow control filter string; and forming a well completion structure in which the annular space between the flow control filter string and the perforated pipe and the annular space between the perforated pipe and the borehole wall are filled with the anti-channeling pack-off particles.

The particle-carrying fluid carrying the anti-channeling pack-off particles is water or aqueous solution.

The anti-channeling pack-off particles may be high molecular polymer particles with an average particle size ranging from 0.05 mm to 1.0 mm and a density ranging from 0.8 g/cm$^3$ to 1.4 g/cm$^3$.

The anti-channeling pack-off particles may be high molecular polymer particles with an average particle size ranging from 0.1 mm to 0.5 mm and a density ranging from 0.94 g/cm$^3$ to 1.06 g/cm$^3$.

The anti-channeling pack-off particles may be high-density polyethylene particles with an average particle size ranging from 0.1 mm to 0.5 mm and a density ranging from 0.90 g/cm$^3$ to 0.98 g/cm$^3$.

The anti-channeling pack-off particles may be styrene and divinylbenzene crosslinking copolymer particles with an average particle size ranging from 0.05 mm to 1.0 mm and a density ranging from 0.96 g/cm$^3$ to 1.06 g/cm$^3$.

The anti-channeling pack-off particles may be polypropylene and polyvinyl chloride high molecular polymer particles with an average particle size ranging from 0.05 mm to 1.0 mm and a density ranging from 0.8 g/cm$^3$ to 1.2 g/cm$^3$.

Although the present application has been described with reference to the preferred embodiments of the present application, it should be understood that, the present application is not limited to the disclosed embodiments or structures. On the contrary, it is intended that the present application covers various modifications and equivalent solutions. In addition, various elements of the present application disclosed herein are shown in various exemplary combinations and structures, but other combinations and structures including more or less elements or only one element are also deemed to fall into the protection scope of the present application.

What is claimed is:

1. A sectional flow control method for an oil-gas well comprising:

forming a first annular space between a borehole wall of the oil-gas well and a perforated pipe, wherein the perforated pipe is located inside the oil-gas well and extends along an axial direction of the oil-gas well, wherein the perforated pipe is hung with a first packer between an upper portion of the perforated pipe and the borehole wall;

forming a second annular space between the perforated pipe and a flow control filter string, wherein a flow control filter is provided on the flow control filter string, and the flow control filter string is located inside the perforated pipe and extends along the axial direction of the oil-gas well;

filling anti-channeling pack-off particles into the first annular space and the second annular space such that fluid is capable of flowing in a penetration manner in the first annular space and the second annular space filled with the anti-channeling pack-off particles; and hanging the flow control filter string with a second packer between an upper portion of the flow control filter string and the borehole wall, wherein the second packer is located upstream from the first packer, and wherein a flow of the fluid along the axial direction of the oil-gas well is limited and thus a function of packing is realized, and a sectional flow is controlled by the flow control filter string.

2. The method according to claim 1, wherein filling the anti-channeling pack-off particles into the first annular space and the second annular space is performed by injecting particle-carrying fluid with the anti-channeling pack-off particles into the first annular space and the second annular space.

3. The method according to claim 2, wherein the particle-carrying fluid has a density substantially equal to a density of the anti-channeling pack-off particles.

4. The method according to claim 2, wherein the particle-carrying fluid is water or aqueous solution.

5. The method according to claim 2, wherein a difference between a density of the particle-carrying fluid and a density of the anti-channeling pack-off particles is within a range of $\pm 0.4$ g/cm$^3$.

6. The method according to claim 2, wherein a difference between a density of the particle-carrying fluid and a density of the anti-channeling pack-off particles is within a range of $\pm 0.2$ g/cm$^3$.

7. The method according to claim 1, wherein the anti-channeling pack-off particles are high molecular polymer particles with an average particle size ranging from 0.05 mm to 1.0 mm and a density ranging from 0.8 g/cm$^3$ to 1.4 g/cm$^3$.

8. The method according to claim 1, wherein the anti-channeling pack-off particles are high molecular polymer particles with an average particle size ranging from 0.1 mm to 0.5 mm and a density ranging from 0.94 g/cm$^3$ to 1.06 g/cm$^3$.

9. The method according to claim 1, wherein the anti-channeling pack-off particles are high-density polyethylene particles with an average particle size ranging from 0.1 mm to 0.5 mm and a density ranging from 0.90 g/cm$^3$ to 0.98 g/cm$^3$.

10. The method according to claim 1, wherein the anti-channeling pack-off particles are styrene and divinylbenzene crosslinking copolymer particles with an average particle size ranging from 0.05 mm to 1.0 mm and a density ranging from 0.96 g/cm$^3$ to 1.06 g/cm$^3$.

11. The method according to claim 1, wherein the anti-channeling pack-off particles are polypropylene and polyvinyl chloride high molecular polymer particles with an average particle size ranging from 0.05 mm to 1.0 mm and a density ranging from 0.8 g/cm$^3$ to 1.2 g/cm$^3$.

12. The method according to claim 1, wherein the anti-channeling pack-off particles are filled into the first annular space and the second annular space until the first annular space and the second annular space are substantially full of the anti-channeling pack-off particles, and the first annular space and the second annular space are closed.

13. The method according to claim 1, wherein the oil-gas well is a horizontal well or an inclined well.

14. A sectional flow control method using a flow control filter string in an oil-gas well with a borehole wall, comprising:

1) running a perforated pipe in the oil-gas well, one end of the perforated pipe adjacent to a wellhead being fixedly connected to the borehole wall with a first packer, and a first annular space is formed between the perforated pipe and the borehole wall;

2) running the flow control filter string into the perforated pipe via a running string, wherein the flow control filter string is provided with a flow control filter, and a second annular space is formed between the flow control filter string and the perforated pipe;

3) injecting particle-carrying fluid with the anti-channeling pack-off particles into the second annular space between the flow control filter string and the perforated pipe, wherein the particle-carrying fluid carrying the anti-channeling pack-off particles passes through holes in the perforated pipe and into the first annular space between the perforated pipe and the borehole wall, the anti-channeling pack-off particles are accumulated both in the second annular space between the flow control filter string and the perforated pipe and in the first annular space between the perforated pipe and the borehole wall, so that the second annular space between the flow control filter string and the perforated pipe and the first annular space between the perforated pipe and the borehole wall are filled with and full of the anti-channeling pack-off particles;

4) closing the second annular space full of the anti-channeling pack-off particles between the flow control filter string and the perforated pipe, and closing the first annular space full of the anti-channeling pack-off particles between the perforated pipe and the borehole wall, wherein an upper portion of the flow control filter string is fixedly connected to the borehole wall by a second packer located upstream from the first packer; and 5) disengaging the running string which is connected to the flow control filter string, and forming a well completion structure in which the second annular space between the flow control filter string and the perforated pipe and the first annular space between the perforated pipe and the borehole wall are filled with the anti-channeling pack-off particles, wherein a flow of the fluid along the axial direction of the oil-gas well is limited and thus a function of packing is realized, and a sectional flow is controlled by the flow control filter string.

* * * * *